US006832796B1

(12) United States Patent
Minassians

(10) Patent No.: US 6,832,796 B1
(45) Date of Patent: Dec. 21, 2004

(54) PET LITTER COLLECTION BAG AND SPATULA

(76) Inventor: Hrair Minassians, 9700 Mason Ave., Chatsworth, CA (US) 91311

( * ) Notice: Subject to any disclaimer, the term of this patent is extended or adjusted under 35 U.S.C. 154(b) by 0 days.

(21) Appl. No.: 10/646,173

(22) Filed: Aug. 21, 2003

Related U.S. Application Data

(63) Continuation-in-part of application No. 29/175,027, filed on Jan. 29, 2003, now abandoned, and a continuation-in-part of application No. 29/172,560, filed on Dec. 13, 2002, now abandoned.

(51) Int. Cl.[7] ..... A01K 29/00; E01H 1/12
(52) U.S. Cl. ..... 294/1.3; 294/25
(58) Field of Search ..... 294/1.3–1.5, 25, 294/55; 15/257.1; 383/4

(56) References Cited

U.S. PATENT DOCUMENTS 3,850,467 A * 11/1974 Johnson ..... 294/1.3
3,978,540 A * 9/1976 Peck et al. ..... 294/1.3
4,132,442 A * 1/1979 Larsson ..... 294/1.3
4,200,319 A * 4/1980 Cooper ..... 294/1.4
4,741,565 A * 5/1988 Bagg ..... 294/1.3
5,282,660 A * 2/1994 Halling ..... 294/1.3
5,358,295 A * 10/1994 Campbell ..... 294/1.3
5,836,629 A * 11/1998 Hobart ..... 294/1.3
6,116,668 A * 9/2000 Carpol ..... 294/1.3
D460,223 S * 7/2002 Daniels ..... D30/162

FOREIGN PATENT DOCUMENTS

GB 2250677 * 6/1992 ..... 294/1.3

* cited by examiner

*Primary Examiner*—Dean J. Kramer
(74) *Attorney, Agent, or Firm*—Jack C. Munro

(57) ABSTRACT

A pet litter collection bag and spatula which comprises a flexible walled bag which has a closed end and an open end. At the closed end is mounted a spatula with a graspable handle of the spatula extending within the confines of the internal compartment of the bag. The spatula is thin and bendable so as to be manually deformable to accommodate to the shape of the terrain on which it is being used to scoop up the pet litter. Once the pet litter is located on the spatula, the bag is reversed in position enclosing the front portion of the spatula with the open end of the bag to be tied to a closing position.

2 Claims, 2 Drawing Sheets

PET LITTER COLLECTION BAG AND SPATULA

REFERENCE TO PRIOR APPLICATIONS

This application is a continuation-in-part of U.S. patent application Ser. No. 29/172,560, filed Dec. 13, 2002, now abandoned entitled ARTICLE OF MANUFACTURE FOR PICKING UP AND DISPOSING OF SMALL ANIMAL EXCREMENT'S and U.S. patent application Ser. No. 29/175,027, filed Jan. 29, 2003 by the same title and both by the present inventor and now abandoned.

BACKGROUND OF THE INVENTION

1. Field of the Invention

The field of this invention relates to a combination bag and spatula for collecting objects, and specifically, although not exclusively, picking up and removing animal excrements.

2. Description of the Related Art

The subject matter of the present invention has particular utility for collecting and removing of pet litter which can be defined as animal excrements. However, the subject matter of this invention could be used to collect and remove any undesirable objects, such as for example, a mousetrap, a dead small animal, and so forth.

It is desirable, and actually required by many municipalities by ordinance, that pet owner's are required to collect the defecation of the pet if that defecation occurs other than on the pet owner's property. When a pet owner is walking a dog and a defecation occurs, pet owners will commonly have in their possession a paper towel, rag, plastic bag or even a cut down milk container in conjunction with a shovel, which can be used to clean up any mess that is left by the pet. It can be appreciated that it is awkward and cumbersome to carry a cut down milk container and a shovel while walking a pet, and therefore this is undesirable. Also, the using of a paper towel, a plastic bag, towel or rag is also not particularly desirable because the user's hand is very close to the defecation and also there is no structure that facilitates the disposal of it.

In the past, there has been designed numerous types of devices that are intended to facilitate the collection of animal feces. Some of these devices utilizes a plastic bag which has either a collection container or a spatula mounted at the closed end of the bag. Once the feces are collected into the container, or located on the spatula, then the bag is to be reversely positioned, tied off and then is to be disposed of in an appropriate trash can or other similar type of trash container. However, in the past, these devices have experienced certain deficiencies. One deficiency is that the spatula type device is a rigid structure and is not designed to accommodate to the specific terrain on which the collection is occurring. The spatula does not deform to accommodate to an uneven terrain or a loose terrain, and as a result, when performing the scooping motion with the spatula, all that occurs is that the feces are moved forward and not readily moved onto the upper surface of the spatula. Also, the forward edge of the spatula is not designed to include any shape that facilitates the picking up of the feces.

There is a need to construct a pet litter collection bag and spatula that makes it easy to pick up animal feces and then also makes it easy to dispose of the animal feces.

SUMMARY OF THE INVENTION

The basic embodiment of the present invention is directed to a pet litter collection bag and spatula which utilizes a flexible walled bag which has a first internal compartment. The bag has an inner end and an outer end with the outer end being open forming an access opening. The spatula has a front portion which extends exteriorly of the bag. The spatula also has a rear surface which is mounted within the first internal compartment. A graspable handle is mounted at the rear surface and is also located within the first internal compartment. The front portion includes a scooping edge. The spatula has a top surface on which the pet litter is to be accumulated. The spatula is formed also of a bendable material. A user's hand is to be inserted through the access opening with the user's hand grasping the graspable handle and then maneuvering, which includes bending, the spatula to cause the pet litter to be located on the top surface of the spatula. The user then reverses the position of the bag locating the front portion of spatula and the pet litter within a newly formed second internal compartment of the bag eliminating the first internal compartment.

A further embodiment of the present invention is where the basic embodiment is modified by there being formed a pair of handles on the bag directly adjacent the access opening with these handles being capable of being tied together to essentially close the access opening after the pet litter has been accumulated within the bag.

A further embodiment of the present invention is where the first basic embodiment is modified by the top surface of the spatula being roughened to facilitate the retention of the pet litter on the spatula.

A further embodiment of the present invention is where the basic embodiment is modified by the spatula being constructed of a plastic foam material.

A further embodiment of the present invention is where the leading edge or scooping edge of the spatula includes a series of scallops to facilitate the picking up of the pet litter.

A further embodiment of the present invention is where the basic embodiment is modified by the attaching of the spatula at the inner end of the bag resulting in closing of the internal compartment at this end of the bag.

A further embodiment of the present invention is where the just previous embodiment is modified by there being formed a handle assembly located at the outer end of the bag located directly adjacent the access opening.

A further embodiment of the present invention is where the just previous embodiment is modified by the top surface of the spatula being roughened.

A further embodiment of the present invention is where the just previous embodiment is modified by the spatula being constructed of a plastic foam material.

A further embodiment of the present invention is where the just previous embodiment is modified by the scooping edge or leading edge of the spatula being scalloped to facilitate the scooping up of the pet litter.

A further embodiment of the present invention is where the just previous embodiment is modified by the spatula being mounted in conjunction with the bag to function to close the inner end of the bag.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
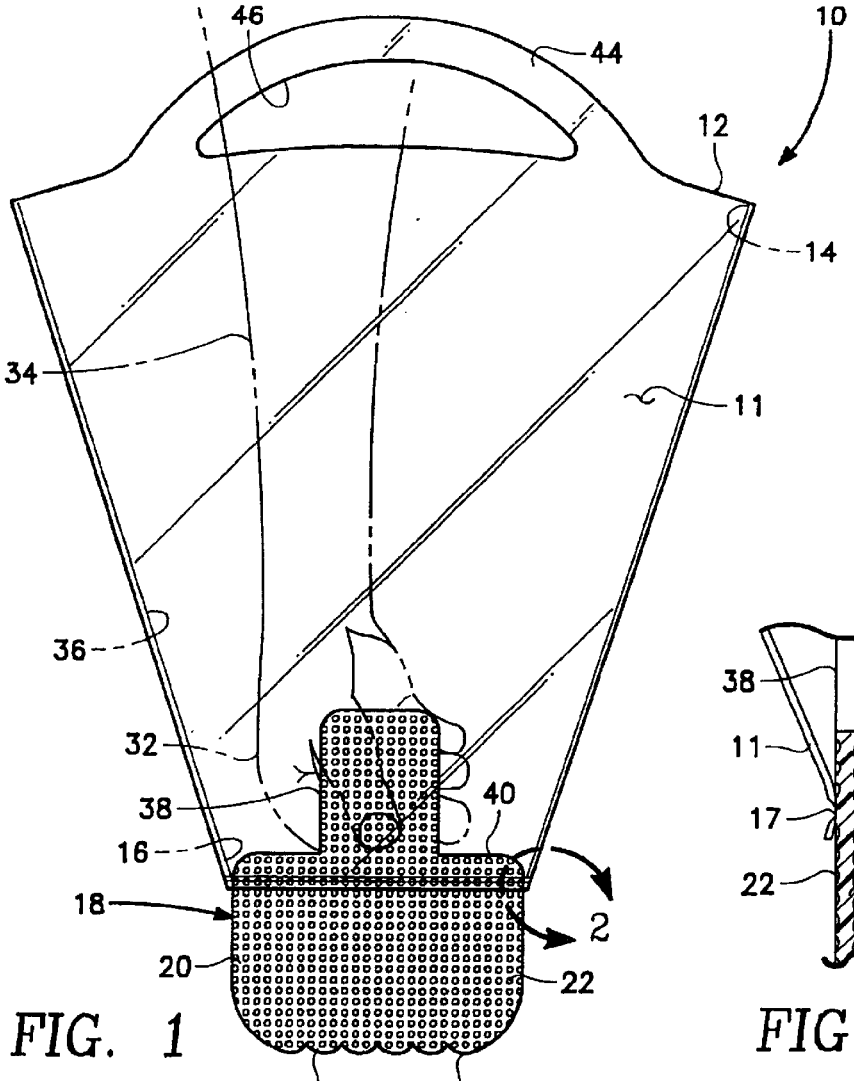
FIG. 1 is a top plan view of the pet litter collection bag and spatula of the present invention depicting usage with a user's arm and hand which would be the position of usage to pick up pet litter.

Referring particularly to the drawings, there is shown the pet litter collection bag and spatula 10 of this invention. The pet litter collection bag and spatula 10 of this invention has a basic trapezoidal shaped, flexible walled bag 11. The bag 11 will normally be a few mils thick and may be transparent or may be opaque. The bag 11 will normally be constructed of plastic. The bag 11 has an outer end 12 which is open forming an access opening 14. The bag 11 also has an inner end 16 which is closingly mounted onto a spatula 18. The spatula 18 is to be constructed of a thin, foam plastic material. A typical material of construction would be a polyurethane foam. The thickness of the spatula 18 will generally be between 1/32 of an inch and 1/16 of an inch.

Figure 2:
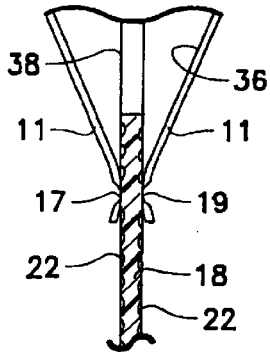
FIG. 2 is a cross-sectional view taken along line 2—2 of FIG. 1 showing the sealing connection between the bag and the spatula.
Figure 3:
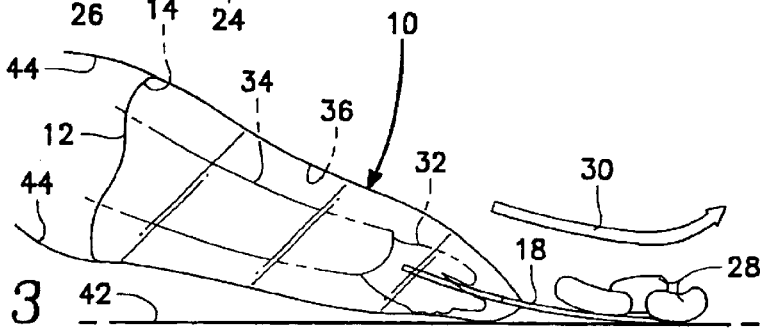
FIG. 3 is a diagrammatic view depicting usage of the collection bag and spatula of FIG. 1 in order to pick up a quantity of pet litter.
Figure 4:
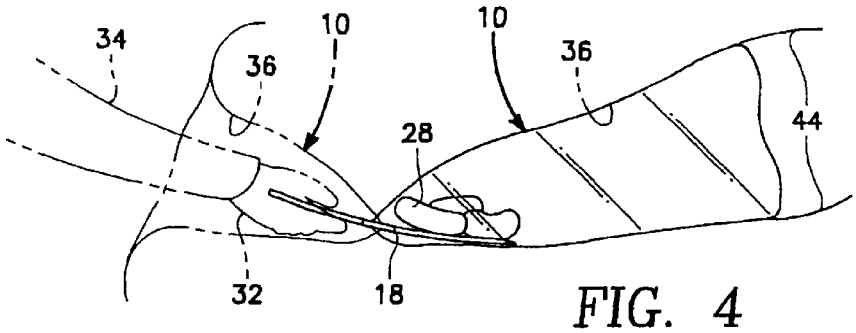
FIG. 4 is a diagrammatic view similar to FIG. 3 but showing the collection bag in the reverse position enclosing the picked up pet litter.
Figure 6:
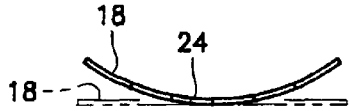
FIG. 6 is an end view of the spatula included within the pet litter collection bag and spatula of the present invention showing how the spatula can be manually deformed to an arcuate shape.
Figure 7:
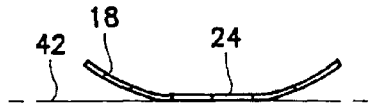
FIG. 7 is a view similar to FIG. 6 but showing the spatula being pressed against a surface upon which a collection of pet litter is to occur.

The spatula 18 has a top surface 20 which is formed into a roughened area 22. Roughened area 22 comprises a mass of evenly spaced apart recesses which is clearly shown in FIGS. 1 and 2. Each recess has a closed bottom. The spatula 18 has a scooping edge or leading edge 24 which is formed into a series of scallops 26. The scallops 26 are rounded, smoothly contoured, bumps not having any sharp edges. The scallops 26 facilitates the slipping of the scooping edge 24 beneath a quantity of pet litter 28, as is shown in FIG. 3, because of the smooth, arcuate front surface of the scallops. The scooping direction is depicted by arrow 30. When performing of the scooping, the user's hand 32 and arm 34 are located within the internal chamber 36 of the bag 11. The user's hand is to be used to grasp onto a graspable handle 38 which is mounted integrally to and extending from rear edge 40 of the spatula 18. It is to be noted that the thickness of the spatula 18 is constant, but actually could vary. The user has the option, when manually grasping of the graspable handle 38, to cause the spatula 18 to manually deform to an arcuate configuration, such as is shown in FIG. 6. Also, by the user pressing down against the surface 42, the spatula 18 can assume a flush position with the surface 42, as is shown in FIG. 7. This is to facilitate the picking up of the pet litter 28.

The bag 16 can be heat sealed or can be adhesively sealed forming seals 17 and 19 or can be secured in any other conventional manner in conjunction with the spatula 18. The size of the graspable handle 38 can be any desirable size with generally a length of about three inches and a width of about two inches being preferred. Typically, the length of the collecting surface of the spatula 18, which is located between the leading edge 24 and read edge 40, will generally be in the range of four to six inches.

Figure 5:
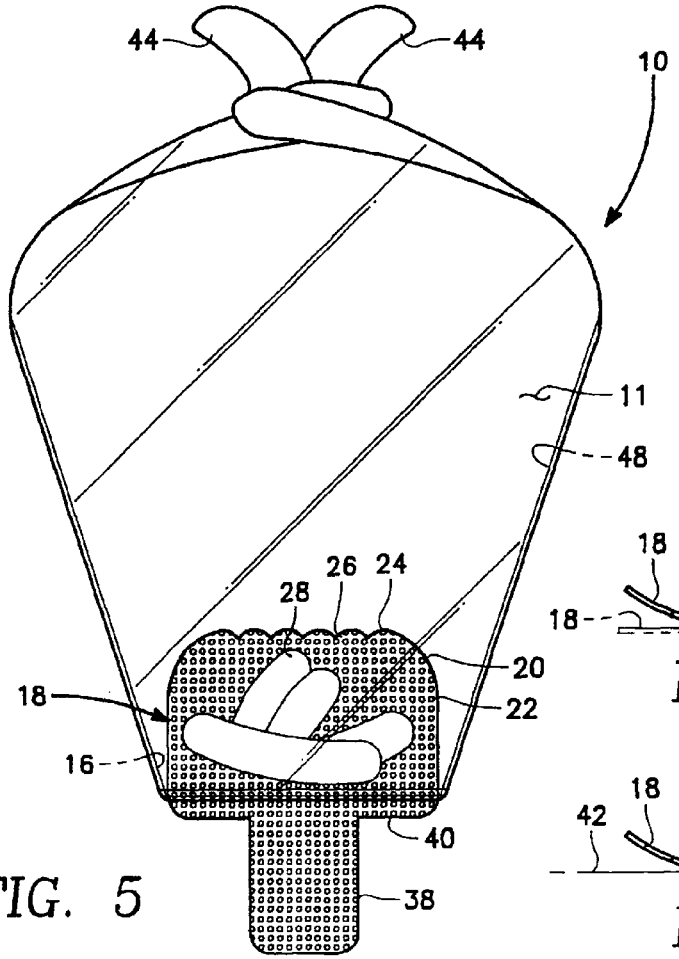
FIG. 5 is a view similar to FIG. 1 but where the bag has been reversed and encloses the pet litter and the outer portion of the spatula and with the handle assembly tied thereby substantially closing of the access opening of the bag permitting the entire bag and its contents to be readily disposed of in any trash container.

Mounted on the bag 11 and located in the area of the access opening 14 are a pair of handle strips 44. Each handle strip 44 has a hole 46. Normally, the handle strips 44 are located side-by-side. The user's hand 32 and arm 34 is to be inserted through the access opening 14 until the user's hand is able to grasp on the graspable handle 38. After picking up of the pet litter 28, the user is to grasp the bag 11 in the area of the handle strips 44 and reverse the bag 11 by turning it inside out with the result that the bag 11 is now enclosing the front portion of the spatula 18 on which is located the pet litter 28. The user can then release his or her grip on the handle 38 and then proceed to tie the handle strips 44 together, as is shown in FIG. 5. The pet litter collection bag and spatula 10 of this invention can then be disposed of in an appropriate disposing location. When the bag 11 is reversed, as shown in FIG. 5, there is formed a second internal compartment 48 within which the pet litter 28 is located as well as the front portion of the spatula 18.

What is claimed is:

1. A pet litter collection bag and spatula comprising:

a flexible walled bag having a first internal compartment, said bag having an inner end and an outer end, said outer end being open forming an access opening;

a single layer spatula having a front surface and a rear surface, a graspable handle attached to said rear surface, said front surface being formed in a scooping edge, said spatula having a top surface, said spatula being formed of a bendable material, said spatula being mounted to said inner end of said bag, said spatula closing said bag with said front surface located exteriorly of said bag and said rear surface being located within said first internal compartment;

whereby a user's hand and arm is to be inserted through said access opening with the user's hand grasping said graspable handle and then maneuvering said spatula to cause pet litter to be supported on said top surface, then the user reverses the position of said bag locating said spatula and the pet litter within a newly formed second internal compartment of the bag eliminating said first internal compartment; and said top surface having a roughened area, said roughened area comprising a mass of evenly spaced apart recesses each of which has a closed bottom, said roughened area facilitating the retention of pet litter on said top surface after such has been collected.

2. A pet litter collection bag and spatula comprising:

a flexible walled bag having a first internal compartment, said bag having an inner end and an outer end, said outer end being open forming an access opening;

a single layer spatula having a front surface and a rear surface, a graspable handle attached to said rear surface, said front surface being formed in a scooping edge, said spatula having a top surface, said spatula being formed of a bendable material, said spatula being mounted to said inner end of said bag, said spatula closing said bag with said front surface located exteriorly of said bag and said rear surface being located within said first internal compartment;

whereby a user's hand and arm is to be inserted through said access opening with the user's hand grasping said graspable handle and then maneuvering said spatula to cause pet litter to be supported on said top surface, then the user reverses the position of said bag locating said spatula and the pet litter within a newly formed second internal compartment of the bag eliminating said first internal compartment;

said scooping edge being scalloped forming a series of smoothly contoured bumps which facilitates the picking up of the pet litter; and said top surface having a roughened area, said roughened area comprising a mass of evenly spaced apart recesses each of which has a closed bottom, said roughened area facilitating the retention of pet litter on said top surface after such has been collected.

* * * * *